US007503137B2

(12) United States Patent
Filicietti

(10) Patent No.: US 7,503,137 B2
(45) Date of Patent: Mar. 17, 2009

(54) FIREARM STOCK WITH AMMUNITION STORE

(75) Inventor: Stephen Dominic Filicietti, Brisbane (AU)

(73) Assignee: Clever Dog Pty Ltd, Wellington Point, Queensland (AU)

( * ) Notice: Subject to any disclaimer, the term of this patent is extended or adjusted under 35 U.S.C. 154(b) by 323 days.

(21) Appl. No.: 11/568,159

(22) PCT Filed: Apr. 22, 2005

(86) PCT No.: PCT/AU2005/000566

§ 371 (c)(1),
(2), (4) Date: Oct. 20, 2006

(87) PCT Pub. No.: WO2005/103598

PCT Pub. Date: Nov. 3, 2005

(65) Prior Publication Data

US 2008/0190004 A1 Aug. 14, 2008

(30) Foreign Application Priority Data

Apr. 22, 2004 (AU) ..... 2004902124

(51) Int. Cl.
*F41C 23/22* (2006.01)

(52) U.S. Cl. ..... 42/71.01

(58) Field of Classification Search ..... 42/71.01, 42/85, 90

See application file for complete search history.

(56) References Cited

U.S. PATENT DOCUMENTS 394,376 A * 12/1888 Kelton ..... 42/71.01
711,989 A 10/1902 Marble
919,641 A * 4/1909 Rodgers ..... 42/71.01
922,173 A * 5/1909 Lovelace ..... 42/71.01
1,110,209 A * 9/1914 Kirchner ..... 42/71.01
1,517,420 A 12/1924 Fritz
1,526,847 A * 2/1925 Lewis ..... 42/71.01
1,693,289 A 11/1928 Warren
2,298,678 A * 10/1942 Chase ..... 42/71.01
2,476,355 A 7/1949 Brown
2,495,977 A 1/1950 Madsen
2,587,921 A * 3/1952 Suite ..... 42/71.01
3,638,344 A * 2/1972 Wagner et al. ..... 42/71.01
4,850,127 A 7/1989 Davis
5,048,214 A 9/1991 Cohen
5,225,613 A * 7/1993 Claridge ..... 42/74
5,813,157 A 9/1998 Scott
6,829,855 B2 * 12/2004 Seifert ..... 42/71.01
6,874,618 B1 * 4/2005 Cragg ..... 42/90

FOREIGN PATENT DOCUMENTS

DE 215597 10/1909
DE 20014011 1/2002
RU 2077692 4/1997

* cited by examiner

*Primary Examiner*—Troy Chambers
*Assistant Examiner*—Jonathan C Weber
(74) *Attorney, Agent, or Firm*—Shoemaker and Mattare

(57) ABSTRACT

A stock (10 for a firearm, the stock (10) having a main body (11), a recess (12) formed in the main body (11) and an opening (13) into the recess (12) on one side of the main body (11) and a magazine (14) for holding ammunition hingedly mounted to the stock (10) for movement between a first position wherein the magazine (14) and ammunition held in the magazine (14) are located within the recess (12) and a second position in which the magazine (14) can be accessed for placement of ammunition in or withdrawal of ammunition from the magazine (14).

13 Claims, 6 Drawing Sheets

FIREARM STOCK WITH AMMUNITION STORE

TECHNICAL FIELD

The present invention relates to firearms and in particular to firearms which have a stock for example rifles and shotguns.

BACKGROUND ART

Ammunition for rifles or similar firearms is commonly stored on a belt having a number of loops for receiving respective ammunition cartridges or rounds with the belt being worn by a user. Storage of ammunition in this manner is not always convenient and accordingly, a number of different arrangements have been proposed or provided for storing ammunition in or about the stock of a firearm. For example, one product which is marketed by Michael's of Oregon Co. of Oregon City, Oreg. 97045under their Uncle Mike's® brand comprises a heavy-duty neoprene sleeve that is designed to be stretched over the body of a stock. The sleeve has a number of elastic loops attached to it which serve to store individual pieces of ammunition. A disadvantage with this design is that the sleeve adds to the bulk of the stock and may tend to slip off the stock. A further disadvantage is that the primers and projectiles of ammunition stored in the sleeve are exposed.

In U.S. Pat. No. 2,476,355 there is described a gun stock having a number of holes drilled into the top of the stock into which rifle cartridges are inserted for storage. A disadvantage with a stock of this type is that it presents a potential safety hazard since the primers of the cartridges are exposed.

In U.S. Pat. No. 5,813,157 there is described a shotgun stock that includes a recess in which there are mounted several clips for receiving cartridges. A disadvantage with a stock of this type is that access to the shells is somewhat difficult.

It is an object of the present invention to provide a stock for a firearm that provides storage for ammunition and which addresses one or more of the above-described disadvantages of the prior art.

SUMMARY OF THE INVENTION

According to a first aspect of the present invention there is provided a stock for a firearm, said stock having:

a main body, said main body having opposite sides and upper and lower edges, a recess formed in said main body, an opening into said recess through one side of said main body, a magazine for holding ammunition, said magazine having one or more chambers for carrying ammunition, said chamber or chambers having an access opening or openings at the upper side of said magazine, said upper side being adjacent said upper edge of said main body, said magazine including or being mounted to an outer wall member and being supported to said main body for movement between a first position wherein said magazine and ammunition held by said magazine are located within said recess and said outer wall member is substantially flush with the outer adjacent surfaces of said one side of said main body surrounding said opening whereby said magazine does not extend beyond said one side of said main body of said stock and a second position wherein at least said upper side of said magazine is moved out of said recess and is accessible for placement of ammunition into said one or more chambers or withdrawal of ammunition from said one or more chambers.

In one form, the ammunition is supported in the magazine to extend transversely relative to the longitudinal axis of the stock. In another form, the ammunition is supported in the magazine to extend substantially parallel to the longitudinal axis of the stock, The longitudinal aids of the stock is the axis extending longitudinally relative to the axis of the barrel of the firearm.

In a preferred embodiment of the invention, the magazine is supported for pivotal movement between its first and second positions, the pivotal axis being preferably located at or adjacent a lower side of the magazine. Preferably the magazine is hingedly mounted to the stock by a hinge so as to be pivotable about the axis of pivotal movement between its first position in which the magazine is located in the recess and the second position in which the magazine is pivoted partly out of the recess.

In one embodiment, the one or more chambers in the magazine comprise a plurality of bores dimensioned to receive respective ammunition cartridges or rounds. The bores typically are open to the upper side of the magazine so that ammunition cartridges or rounds can be placed into or withdrawn from the bores from the upper side of the magazine, being the side of the magazine adjacent the nominal upper edge of the stock. The bores in this embodiment extend substantially normal to the hinge axis of the magazine. The magazine may include an insert formed of resilient material, the insert including the bores for receiving and resiliently gripping the ammunition cartridges.

In another embodiment, the magazine includes a single chamber for carrying the ammunition cartridges in an attitude extending longitudinally of the stock and longitudinally relative to the hinge axis of the magazine. In this embodiment, the respective cartridges are supported one above the other so that successive uppermost cartridges can be withdrawn in tam from the upper side of the magazine when the magazine is in its second position. Similarly respective cartridges may be placed in turn into the magazine from the upper side thereof for the purposes of loading the magazine.

The magazine in this embodiment may define or include a hollow chamber for receiving the cartridges. Biasing means may be provided to bias the respective cartridges towards the upper side of the magazine. Typically, the biasing means comprise spring biasing means and is associated with a cartridge follower for urging the cartridges upwardly. The chamber for the cartridges may comprise a chamber which is detachable from the stock and/or magazine outer wall.

Preferably a detent assembly is provided to releasably retain the magazine in the first and/or second position. The detent assembly may comprise a spring-loaded ball on the magazine or the stock which can cooperate with one or more apertures or depressions on the stock or magazine respectively.

In an alternative embodiment, the stock may include one or more runners on which the magazine is slid into and out of the recess.

According to a further aspect of the present invention there is provided a firearm, for example a rifle or shotgun, incorporating a stock of any one of the types described above.

BRIEF DESCRIPTION OF THE DRAWINGS

Reference will now be made to accompanying drawings which illustrate preferred embodiments of the invention and wherein.

DETAILED DESCRIPTION OF PREFERRED EMBODIMENTS

Figure 1:
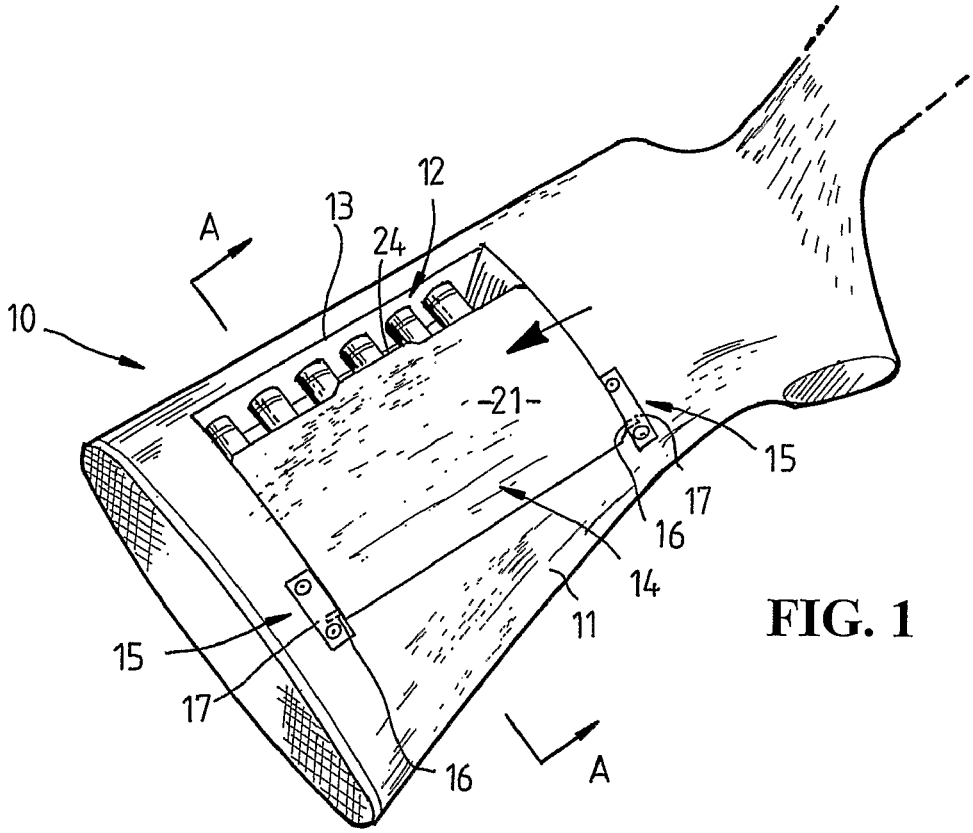
FIG. 1 is a perspective view of a stock according to one preferred embodiment of the invention with the ammunition storage magazine in a first closed position.
Figure 2:
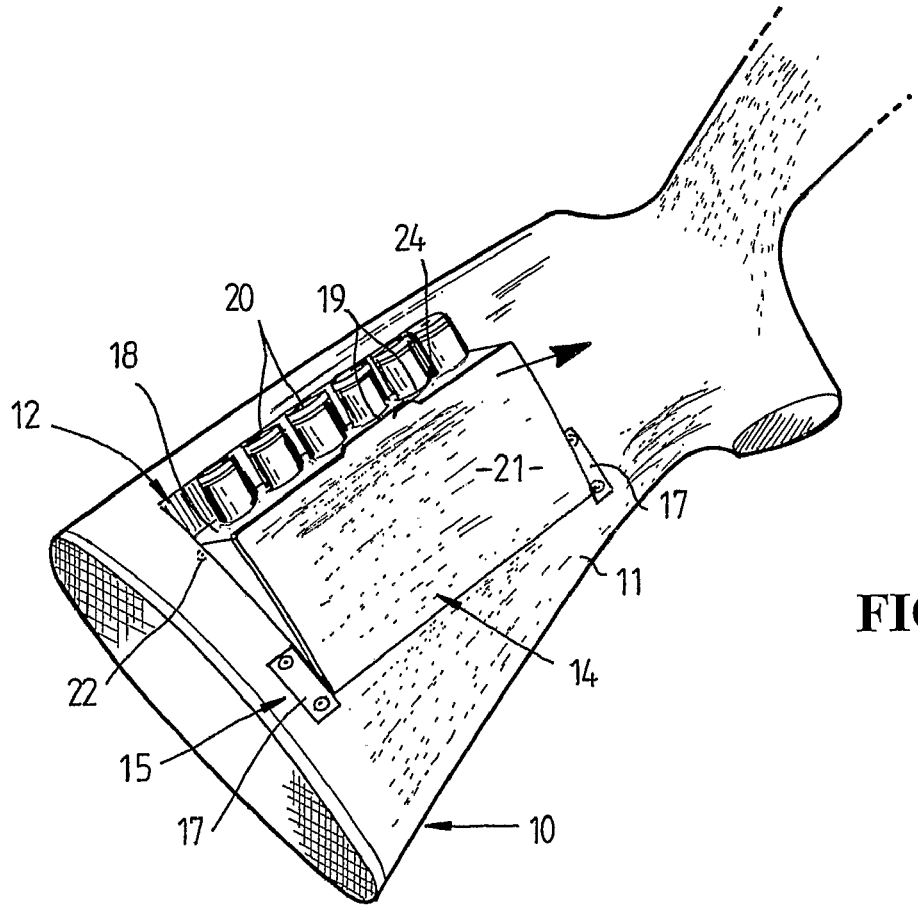
FIG. 2 is a perspective view of the stock of FIG. 1 with the ammunition storage magazine in a second open position.
Figure 3:
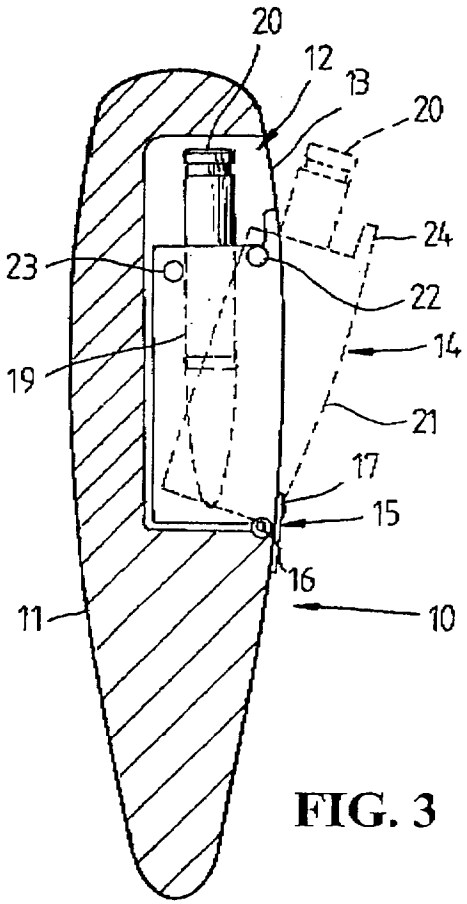
FIG. 3 is an enlarged cross-sectional view of the stock of FIG. 1 along line A-A.

Referring firstly to FIGS. 1 to 3, there is illustrated a firearm stock 10 according to a preferred embodiment of the present invention, the stock 10 in this case being designed as a stock for a rifle or shotgun. The stock 10 has a main body 11 having a blind recess 12 formed therein, the recess 12 opening at 13 to the side of the stock 10 normally facing away from the user. The recess 12 is of a substantially rectangular configuration in side elevation as is apparent more clearly in FIG. 3 and has a depth slightly greater than half the width of the stock body 11.

The recess 12 is adapted to receive an ammunition magazine 14 which is mounted to the stock 10 for movement between the position of FIG. 1 where the magazine 14 is located wholly within the recess 12 to the position of FIG. 2 where the magazine 14 is moved partially out of the recess 12. For this purpose, the magazine 14 is mounted to the stock by means of a hinge 15 connected between a lower part of the magazine 14 and stock body 11. The hinge 15 is typically defined by pintles 16 at opposite ends of the magazine 14 secured by pivot bracket 17 to the stock body 11 at each end of the recess 12 and adjacent to the lower outer edge thereof, being the edge adjacent to the normally lower edge of the stock 10.

The magazine 14 includes an insert 18 in which a number of blind bores 19 are formed for holding cartridges 20, the bores 19 opening to the top side of the magazine 14, being the side of the magazine adjacent the normally upper edge of the stock 10. The bores 19 have their axes extending substantially normal to the hinge axis of the magazine 14 defined by the hinges 15. The insert 18 is made of rubber or a synthetic rubber-like material such that cartridges 20 held within the bores 19 are resiliently gripped. The magazine 14 additionally includes or is fixed to an outer wall member 21 which in the closed position of the magazine shown in FIG. 1 substantially closes the recess opening 13 and is substantially flush with the adjacent outer side surfaces of the stock body 11.

Figure 4:
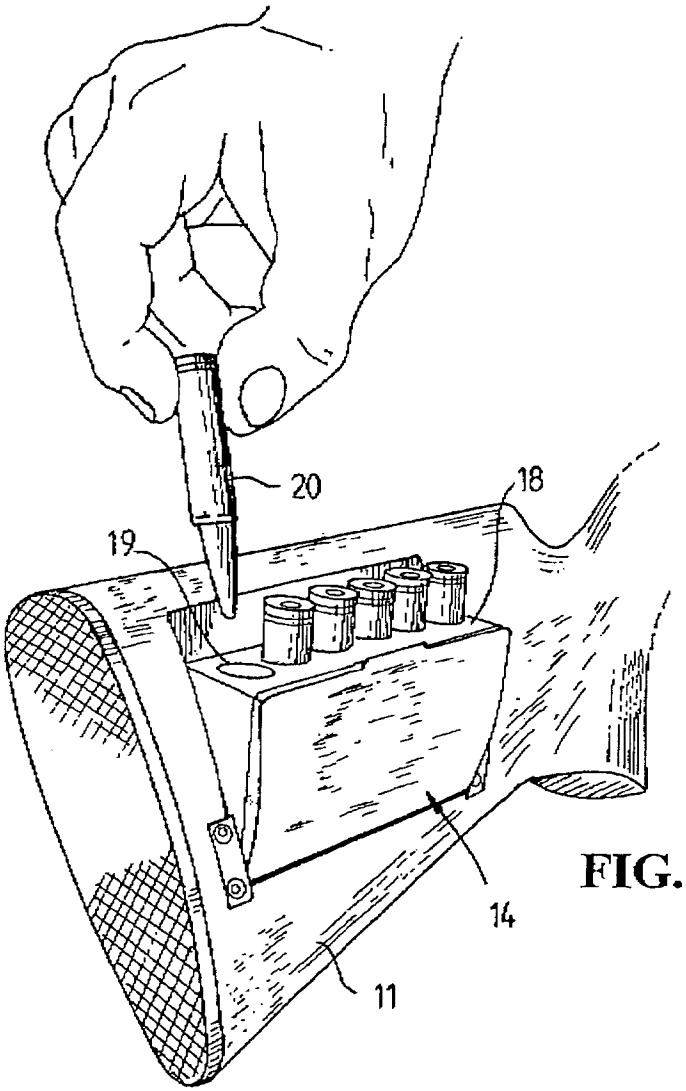
FIG. 4 is a further perspective view of the stock of FIG. 1 showing the manner in which ammunition cartridges are placed into or withdrawn from the magazine.
Figure 5:
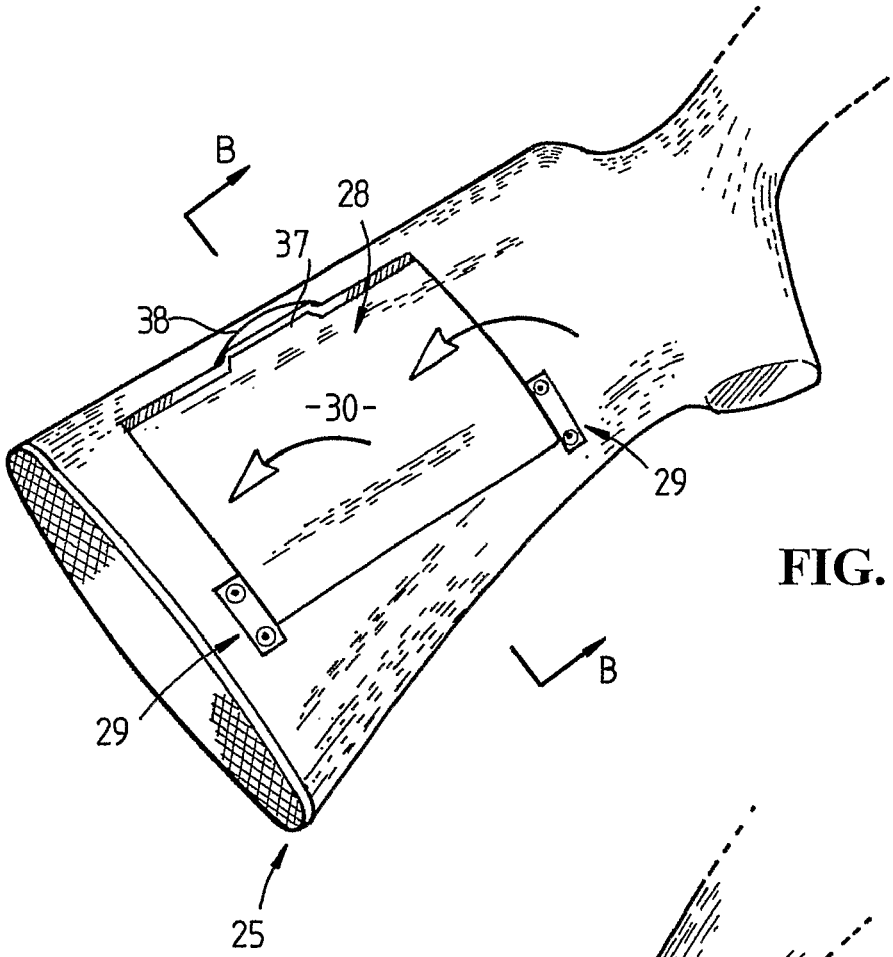
FIGS. 5 and 6 are perspective views of a stock according to another preferred embodiment of the invention with the ammunition storage magazine in a first closed position and second open position respectively.
Figure 6:
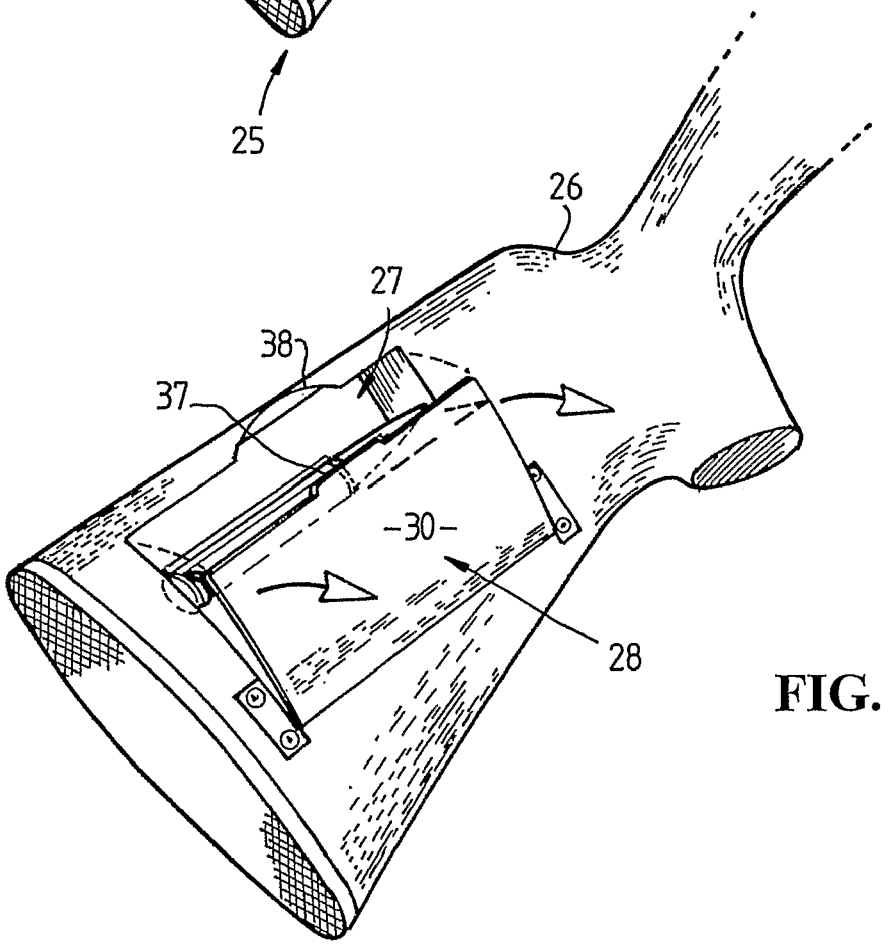
Figure 7:
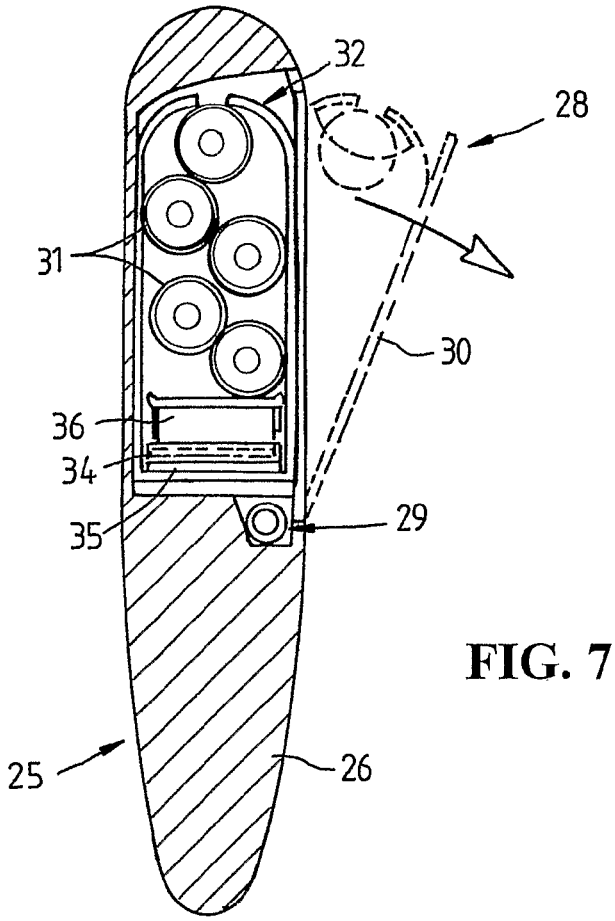
FIG. 7 is an enlarged cross sectional view of the stock of FIG. 5 along line B-B.
Figure 8:
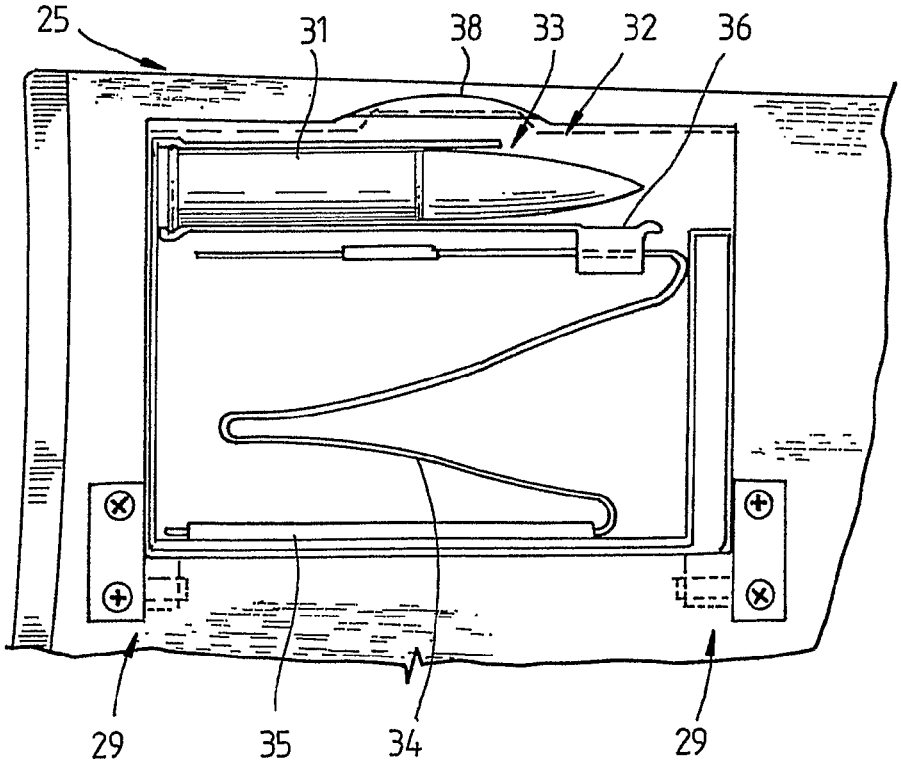
FIG. 8 is a cut-away side view of the stock of FIG. 5 showing details of the magazine containing a single cartridge.

The magazine is held closed by means of a detent assembly comprising a spring-loaded ball 22 held in a lipped tunnel formed in a side of the magazine 14. A portion of ball 22 that protrudes from magazine 14 is receivable into a corresponding depression or depressions 23 formed in an opposing side wall of the recess 12 so that the magazine 14 can be positively retained in the closed or open position as shown in FIGS. 1 and 2 respectively. A lip 24 extends upwardly from the upper outer edge of the magazine outer wall 21 for use as a handle In the closed position shown in FIGS. 1 and 3, ammunition cartridges 20 are safely stored within the body 11 of the stock 10. Furthermore the profile of the stock 10 is unaltered from that of a standard stock and in particular the recess 12 and magazine 14 are dimensioned so that ammunition cartridges 20 do not protrude from the stock 10 nor are the primers of the ammunition cartridges 20 exposed.

Where access is required to the ammunition cartridges 20, the lip 24 may be gripped by hand and pulled outwardly to overcome the latching effect of the spring loaded ball 22 to pivot the magazine 14 out to the open angled position as shown in FIGS. 2 and 4 and in phantom outline in FIG. 3. In the open position, cartridges 20 may be readily removed from, or inserted into, the top of the magazine 14 by hand.

Optionally, a safety catch may be mounted on the stock to ensure that the magazine 14 does not pivot out inadvertently.

FIGS. 5 to 9 illustrate a second embodiment of the invention which is similar to the embodiment of FIGS. 1 to 4 with a stock 25 of a rifle or other firearm having a main body 26 with a recess 27 formed therein and opening to one side of the stock. An ammunition magazine 28 is hingedly mounted to the body 26 in the same manner as described above to be hingedly movable about pintle hinges 29 between the closed position of FIG. 5 wherein the outer wall member 30 of the magazine 28 is substantially flush with the adjacent surrounding outer surface of the stock body 26 and the open position of FIG. 6 wherein the magazine 28 is pivoted partially out of the recess 27.

In this embodiment however, the magazine 28 is designed to support cartridges 31 in a stacked relationship extending substantially longitudinally of the stock 25 and substantially parallel to the hinge axis of the magazine 28. The magazine 28 includes a hollow housing or chamber 32 rewarwardly of the wall member 30 for receiving the cartridges 31. Cartridges 31 may be accessed through an opening 33 at the upper end of the housing 32. The housing 32 also contains a leaf spring 34 which is of a generally Z-shaped configuration and which is fixed at its lower end to the base 35 of the housing 34 and which is engaged with a magazine follower 36 constrained for movement within the housing 32 towards and away from the opening 33. The follower 36 applies a biasing force to cartridges 31 within the housing 32 to urge the cartridges 31 towards the opening 33. As with the embodiment of FIGS. 1 to 5, the wall member 30 is provided with an upper lip 37 for gripping by a user. The opposing portion of the stock body 26 opposite the lip 37 includes a curved recess 38 which enable the fingers of the hand to be inserted to grip the lip 37 and pivot the magazine 28 outwardly from the position of FIG. 5 to the position of FIGS. 6 and 9 and as shown in dotted outline in FIG. 7.

Figure 9:
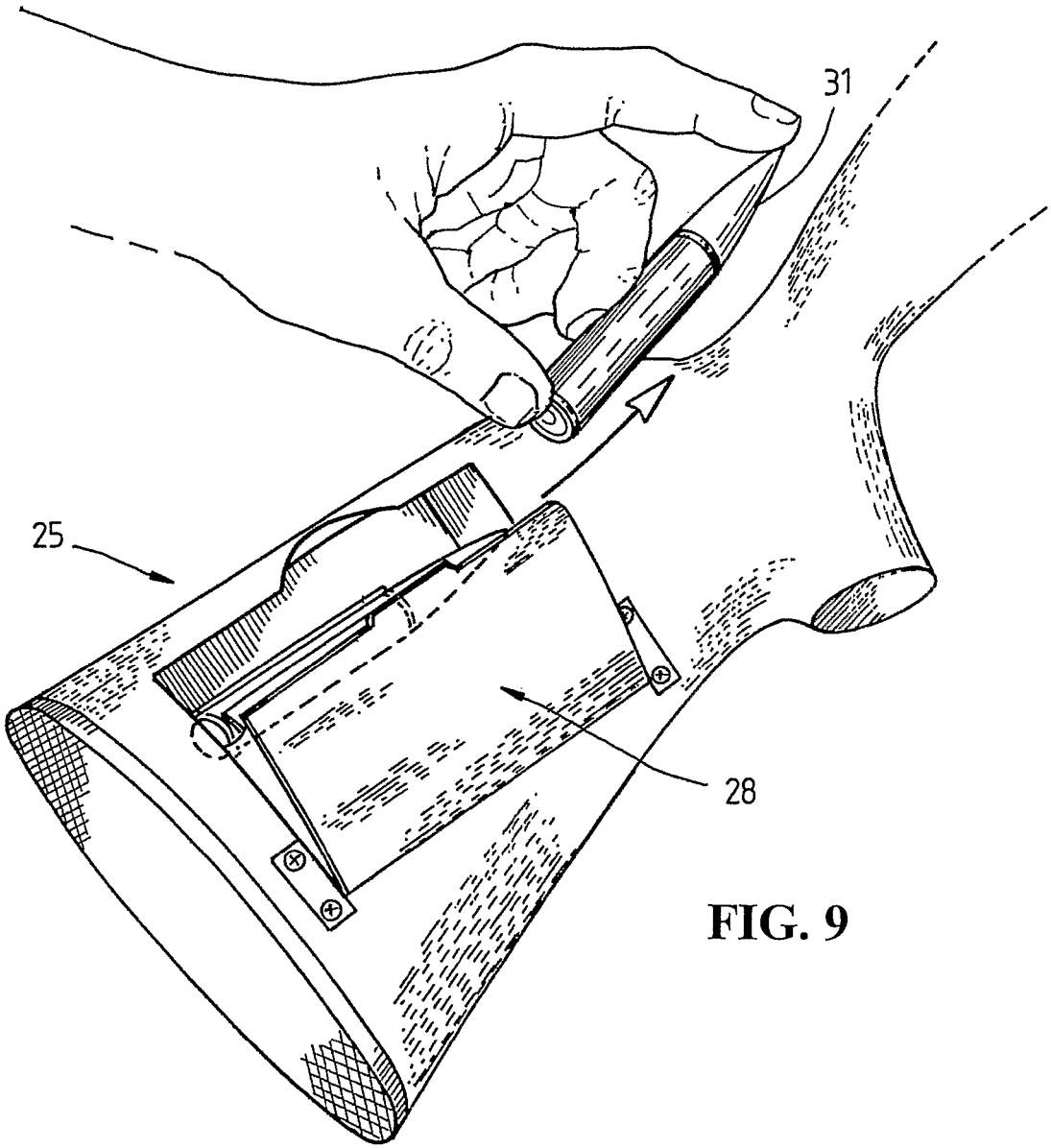
FIG. 9 is a further perspective view of the stock of FIG. 5 showing the manner in which ammunition cartridges are placed into or withdrawn from the magazine.

In the outward pivoted position, cartridges 31 can be withdrawn longitudinally from the magazine 28 through the opening 33 as indicated by the arrow in FIG. 9. Cartridges 31 can be loaded into the magazine chamber 32 in a similar but reverse manner. A detent assembly similar to that described with reference to FIGS. 1 to 4 may be included to provide a positive detent to the magazine 28 in the position of FIG. 5 and/or FIG. 6. Furthermore in the closed position of the magazine 28, the profile of the stock 25 is substantially unaltered from that of a standard stock with the ammunition and magazine 28 wholly contained within the recess 12. It will also be noted that in this embodiment, the wall member 30 substantially occupies and closes the opening into the recess 27 and is substantially flush with the adjacent outer surface of the stock body 26. The chamber 32 may be fixed to the rear side of the wall member 30 or alternatively may be detachably mounted to the wall member 30.

In the above embodiments, the magazines are preferably mounted so as to be pivoted into and out of the recesses in the body of stock. It will be appreciated however that other arrangements for supporting the magazine for movement into and out of the recesses may be used. For example the magazine may be slid on runners into and out of the recess.

Figure 10:
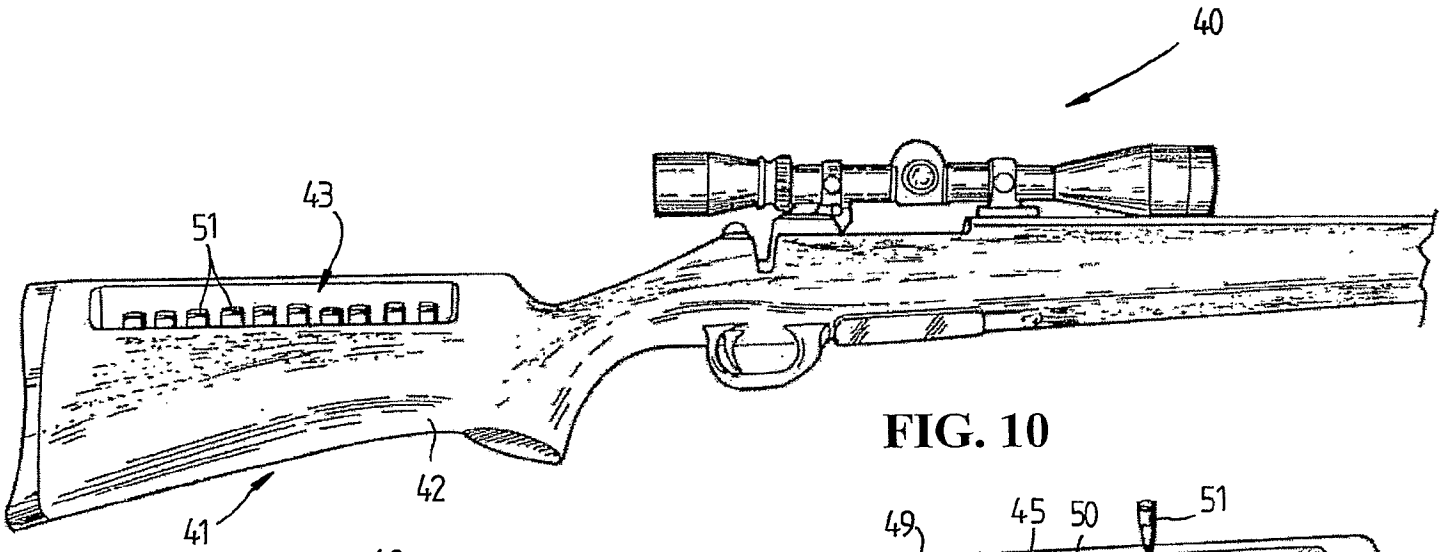
FIG. 10 is a side view of portion of a rifle incorporating a stock according to a further embodiment of the present invention.

Referring now to FIG. 10, there is illustrated a portion of a rifle 40 according to a further embodiment of the invention having a stock 41 with a main body 42 and a recess in the form of a longitudinal slot 43 formed in one side of the stock body 42, being the side of the stock 41 that would be away from a shooter's head during use.

The slot 43 includes a longitudinally extending channel 44 which is recessed into the stock body 42 and an ammunition magazine 45 is received within the slot 43 and channel 44. The magazine 45 is in the form of rubber insert and includes a substantially solid main body portion 46 complementary to the channel 44 and an extending flange 47 which sits against the exposed side wall 48 of the slot 43. The main body portion 46 has a top transversely extending wall 49 which extends inwardly from the upper edge of the channel 44 to the flange 47 and a number of blind bores 50 are formed in the top wall 49 and extend into the main body portion 46. The bores 50 open to the upper side of the body portion 46 and are spaced at regular intervals along the body portion 46. The bores 49 are of a diameter slightly less than or substantially the same as the cartridges 51 so as to receive and grip cartridges 51, being ammunition cartridges of a predetermined type suitable for firing by the rifle 40.

Figure 12:
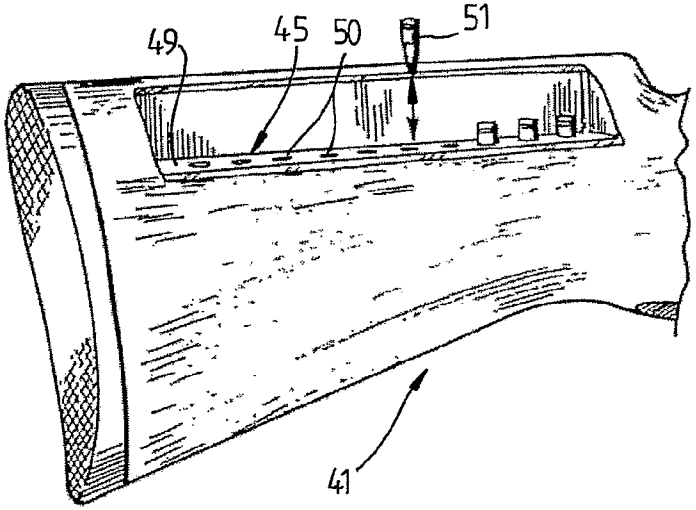
FIG. 12 is a perspective view of the stock of the rifle of FIG. 10 showing the manner in which ammunition cartridges are placed into or withdrawn from the magazine.
Figure 11:
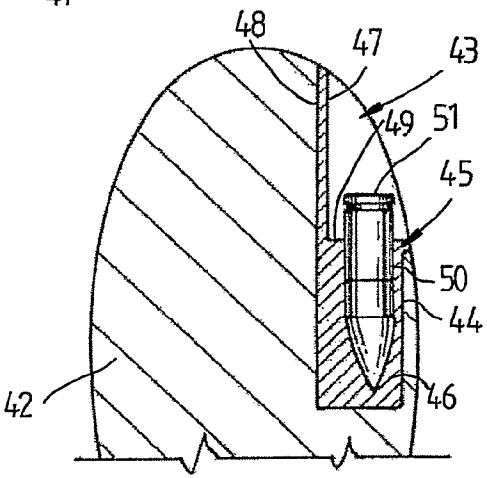
FIG. 11 is a partial cross-sectional view through the stock of FIG. 10.

In use and as indicated by the double headed arrow in FIG. 12, cartridges 51 can be inserted into the bores 50 for storage and then removed for subsequent use. When the cartridges 51 are stored within the bores 50 as shown in FIG. 11, they are located wholly within the profile of the stock body 42 and therefore do not interfere with normal use of the rifle 40. Furthermore, the ammunition cartridges 51 when stored in the magazine 45 are substantially protected from exposure.

It will be appreciated that the magazine 45 whilst preferably being formed of a rubber material may be formed of any other resilient materials such as plastics materials. The magazine 45 may also be formed of non-resilient materials if desired and in this embodiment additions means may be provided to hold the cartridges 51 within the bores.

The magazines of the embodiments of FIGS. 1 to 4 and FIGS. 5 to 9 may be in various configurations and the hinges where used for pivotally supporting the magazines may hinge or pivot devices other than of the form described and illustrated.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. A stock for a firearm, said stock comprising:

a main body, said main body having opposite sides and upper and lower edges, a recess formed in said main body, an opening into said recess through one side of said main body, a magazine for holding ammunition, said magazine having one or more chambers for carrying ammunition, said chamber or chambers having an access opening or openings at an upper side of said magazine, said upper side being adjacent said upper edge of said main body, said magazine including or being mounted to an outer wall member and being hingedly mounted by a hinge to said main body for pivotal movement about an axis located at or adjacent a lower side of said magazine between a first position wherein said magazine and ammunition held by said magazine are located within said recess and said outer wall member is substantially flush with an outer adjacent surfaces of said one side of said main body surrounding said opening whereby said magazine does not extend beyond said one side of said main body of said stock, and a second position wherein said magazine is pivoted partly out of said recess and is accessible for placement of ammunition into said one or more chambers or withdrawal of ammunition from said one or more chambers.

2. A stock as claimed in claim 1 wherein said one or more chambers in said magazine comprise a plurality of bores dimensioned to receive ammunition cartridges, said bores being open to the upper side of said magazine.

3. A stock as claimed in claim 2 wherein said bores are provided in an insert of resilient material and wherein said bores are of a size to resiliently grip ammunition cartridges located therein.

4. A stock as claimed in claim 1 wherein said one or more chambers comprise a single chamber for carrying a plurality of ammunition cartridges.

5. A stock as claimed in claim 4 wherein said chamber is adapted to support cartridges in an attitude extending longitudinally of the stock.

6. A stock as claimed in claim 5 wherein respective cartridges in use are supported one above the other so that successive uppermost cartridges can be withdrawn in turn from said chamber from the upper side of the magazine or placed in turn into the magazine chamber from the upper side when the magazine is in its second position.

7. A stock as claimed in claim 6 and including biasing means for biasing the respective cartridges towards the upper side of the magazine.

8. A stock as claimed in claim 1 and including a detent assembly for releasably retaining the magazine in the first and/or second position.

9. A stock as claimed in claim 8 wherein said detent assembly comprises a spring loaded ball and a recess or recesses for receiving said ball in said first and/or second positions of said magazine.

10. A stock as claimed in claim 8 wherein said one or more chambers in said magazine comprise a plurality of bores dimensioned to receive ammunition cartridges, said bores being open to the upper side of said magazine.

11. A stock as claimed in claim 10 wherein said magazine includes a body of resilient material and wherein said bores are formed in said resilient body and of a size to resiliently grip ammunition cartridges located therein.

12. A stock as claimed in any claim 1 wherein said outer wall member substantially occupies and closes said opening into said recess in said first position of said magazine.

13. A firearm incorporating a stock as defined in claim 1.

* * * * *